United States Patent [19]

Nelson, Jr. et al.

[11] 4,353,496

[45] Oct. 12, 1982

[54] STACKABLE TRAY

[75] Inventors: Bennie C. Nelson, Jr., Romeoville; Jeffrey M. Gardner, Wheaton, both of Ill.

[73] Assignee: Container Corporation of America, Chicago, Ill.

[21] Appl. No.: 227,544

[22] Filed: Jan. 22, 1981

[51] Int. Cl.[3] ..... B65D 5/22

[52] U.S. Cl. ..... 229/34 R; 229/DIG. 11

[58] Field of Search ..... 229/DIG. 11, 34 R, 34 HW, 229/32; 206/44 R

[56] References Cited

U.S. PATENT DOCUMENTS

| | | | |
|---|---|---|---|
| 1,166,263 | 12/1915 | Sackett | 206/44 R |
| 1,498,673 | 6/1924 | Reynolds | 229/37 R |
| 2,078,018 | 4/1937 | Powell | 206/44 R |
| 2,960,149 | 11/1960 | Throssel | 229/34 R |
| 3,326,361 | 6/1967 | Zimmerman | 206/44 R |
| 4,244,509 | 1/1981 | Dlugopolski | 229/DIG. 11 |

*Primary Examiner*—Stephen P. Garbe

*Attorney, Agent, or Firm*—Richard W. Carpenter; Davis Chin

[57] ABSTRACT

A tray having tapered side walls with one of the end walls being of a height corresponding to one end of the tapered side walls and the other end wall of a height higher than the other ends of the tapered side walls is disclosed.

2 Claims, 3 Drawing Figures

STACKABLE TRAY

SUMMARY OF THE INVENTION

The tray structure disclosed lends itself to vertical stacking, and by reason of the configuration of the tray sides and an end wall of the tray, an array of trays one atop another causes a line of centers through the trays to be curved. Within limits imposed by the creation of an unstable static condition, the uppermost loaded trays are displaced from an horizontal plane enabling the tray contents to be advantageously displayed.

THE DRAWING

Figure 2:
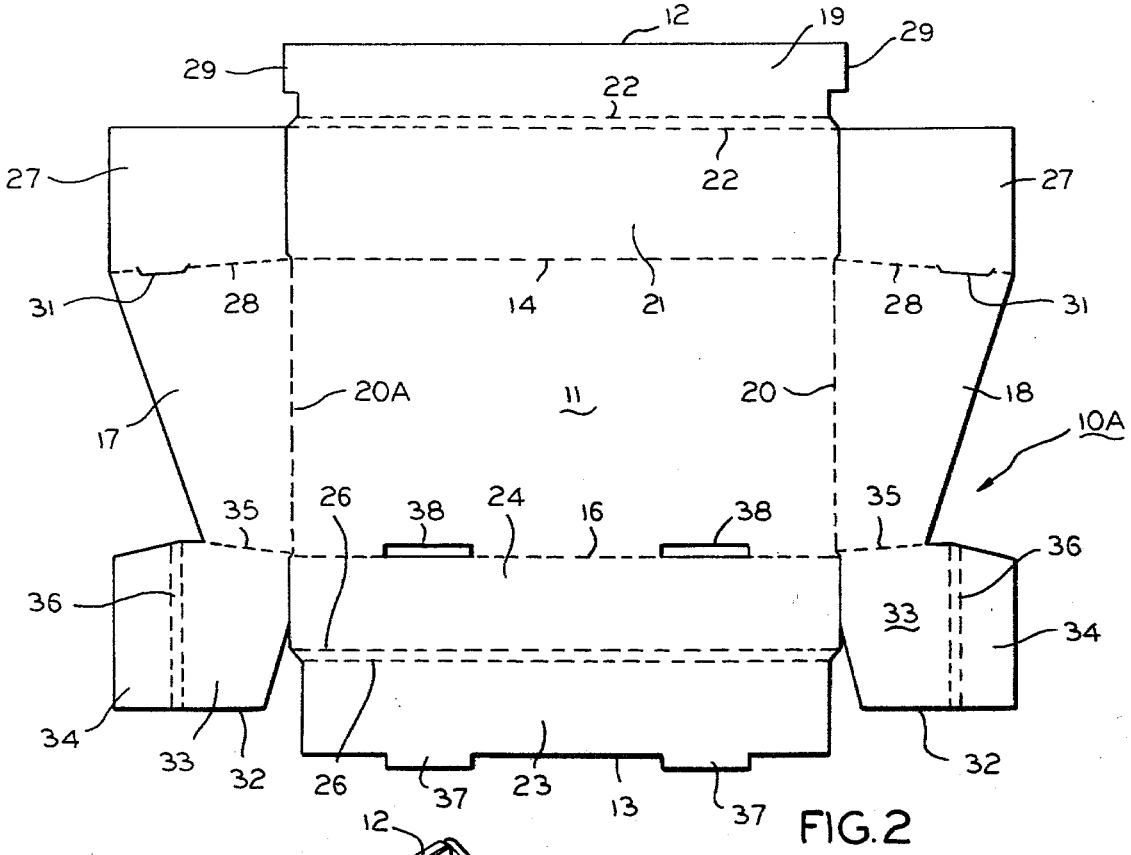
FIG. 2 is a plan view of a cut and scored blank for forming the tray seen in FIG. 1.
Figure 1:
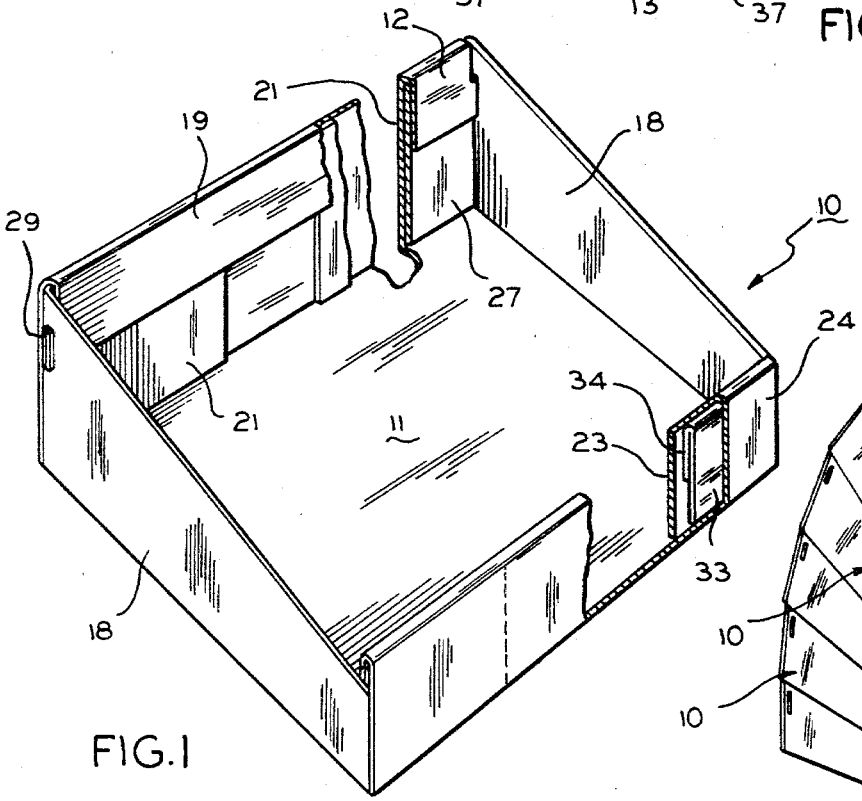
FIG. 1 is a perspective view of a tray constructed in accordance with the teachings of the present invention.
Figure 3:
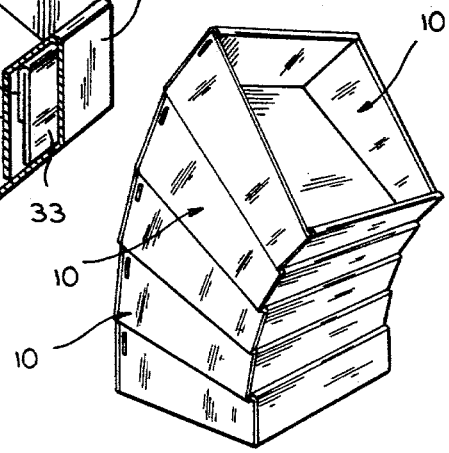
FIG. 3 is a perspective view showing the tray of FIG. 1 placed in a vertical array of same.

The tray according to the invention is denoted by the reference numeral 10 and is formed from a cut and scored blank 10A. The completed trays can be piled one atop another in an array as seen in FIG. 3, where the piling of the trays results in the line of centers through the trays being curved. This results in the contents of the topmost tray being advantageously displayed. The height of the array is limited by the creation of an unstable gravity condition.

Blank 10A includes a rectangular center panel 11 flanked by opposed end walls 12 and 13 foldable with respect thereto along fold lines 14 and 16. Opposed side walls 17 and 18 are foldable with respect to central panel 11 along score lines 20 and 20A.

Wall elements 19 and 21 of end wall 12 are foldable into facing relationship along closely spaced score lines 22,22. Wall elements 23 and 24 of end wall 13 are foldable into facing relationship along spaced score lines 26,26, and wall element 23 is locked in position to central panel 11 by Walker tabs 37 engageable in Walker slots 38 in panel 11.

Structure is provided for connecting side walls 17 and 18 at one end thereof to end wall 12, and each side wall 17 and 18 is provided with a flap 27 at an end thereof foldable into position along a score line 28 between the facing elements 19 and 21. The ends of wall element 19 are provided with locking tabs 29 engageable in slots 31 in fold line 28 between walls 17,18 and flaps 27.

In like fashion the other ends of side walls 17,18 are provided with flaps 32 comprised of a flap portion 33 foldable with respect to the walls 17,18 along a score line 35. Each flap 32 is connected by closely spaced score lines 36 to a flap portion 34.

The two flap portions 33 and 34 are folded into facing relationship about score lines 36 and placed between the facing elements 23 and 24.

The height of side walls 17 and 18 at end wall 12 is equal to the height of the latter. The side walls 17 and 18 are tapered, the height thereof at end wall 13 being less than the height of the latter.

The structure is such that the exposed upper margins of end wall 13 provide an abutment restraining sliding movement of a superimposed tray as seen in FIG. 3.

The configuration of trays 10 makes it possible that the stacked array be arranged in a column along a curved axis.

We claim:

1. A tray particularly adapted for arrangement in a stack so that the tray can be placed atop another similar tray, each tray being formed from a cut and scored blank of paperboard and comprising:

a rectangular center panel;

opposed end walls foldably connected to opposed ends of said central panel, one end wall being taller than the other end wall, each of said opposed end walls having inner and outer wall elements folded into facing relationship, said inner wall element of said one end wall having locking tabs;

opposed side walls foldably connected to said center panel;

said side walls tapering from a height at one end thereof corresponding to the height of one of said end walls to a height at the other end of said tapered side wall which is less than the height of the other end wall;

a flap joined to an end of said side walls adjacent said one end wall and being interposed between said inner and outer wall elements thereof, said flap having a slot formed therein for receipt of said locking tabs;

a first flap portion joined to an end of said side walls adjacent said other end wall, a second flap portion joined to said first flap portion and being folded into facing relationship, said first and second flap portions being interposed between said inner and outer wall elements thereof; and said other end wall having an abutment along upper margins thereof for restraining movement of a superimposed tray out of a stacking arrangement.

2. A tray according to claim 1 wherein an array of trays may be arranged in a column along a curved axis.

* * * * *